US009887489B1

(12) United States Patent
Dietz et al.

(10) Patent No.: US 9,887,489 B1
(45) Date of Patent: Feb. 6, 2018

(54) ELECTRICAL CONNECTOR WITH PLUG LATCHING ASSEMBLY

(71) Applicant: Hubbell Incorporated, Shelton, CT (US)

(72) Inventors: William Henry Dietz, Branford, CT (US); Thomas Louis Scanzillo, Monroe, CT (US); Mark Andrew Condo, Shelton, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/298,114

(22) Filed: Oct. 19, 2016

(51) Int. Cl.

| | |
|---|---|
| ***H01R 4/50*** | (2006.01) |
| ***H01R 13/625*** | (2006.01) |
| ***H01R 13/627*** | (2006.01) |
| ***H01R 13/193*** | (2006.01) |

(52) U.S. Cl.
CPC ..... *H01R 13/6271* (2013.01); *H01R 13/193* (2013.01)

(58) Field of Classification Search
CPC ..... H01R 13/62938; H01R 13/62905; H01R 13/635; H01R 13/639; H01R 13/629; H01R 13/62927
USPC ..... 439/345, 310, 312, 140, 370, 347, 351, 439/352
See application file for complete search history.

(56) References Cited

U.S. PATENT DOCUMENTS

| | | | | |
|---|---|---|---|---|
| 2,241,828 | A | | 5/1941 | Reynolds |
| 3,982,804 | A | | 9/1976 | Marechal |
| 4,109,095 | A | * | 8/1978 | Kling ..... H02G 3/088 174/67 |
| 4,140,358 | A | | 2/1979 | Marechal |
| 4,176,905 | A | | 12/1979 | Marechal |
| 4,488,765 | A | | 12/1984 | Erbe |
| 4,525,610 | A | | 6/1985 | Le Magourou |
| 4,553,000 | A | | 11/1985 | Appleton |
| 4,659,160 | A | | 4/1987 | Jonval |
| 4,678,254 | A | | 7/1987 | Le Magourou |
| 4,784,611 | A | | 11/1988 | Poulin et al. |
| 4,925,396 | A | | 5/1990 | Grover |
| 5,007,857 | A | | 4/1991 | Wright |
| 5,044,977 | A | | 9/1991 | Vindigni |
| 5,055,057 | A | | 10/1991 | Boyer |
| 5,071,360 | A | | 12/1991 | Lindow et al. |
| 5,234,350 | A | | 8/1993 | Marechal |
| 5,244,409 | A | | 9/1993 | Guss, III et al. |
| 5,334,032 | A | | 8/1994 | Myers et al. |
| 5,478,249 | A | | 12/1995 | Crestin |
| 5,503,569 | A | | 4/1996 | Huss, Jr. et al. |
| D369,782 | S | | 5/1996 | Hashizawa |

(Continued)

OTHER PUBLICATIONS

Hubbell (R) Brochure for Advantage (TM) Series Switch-Rated IEC Pin & Sleeve, Four Pages, Nov. 2014.

*Primary Examiner* — Hae Moon Hyeon
(74) *Attorney, Agent, or Firm* — Wissing Miller LLP

(57) ABSTRACT

A latch assembly is provided in a receptacle in a pin-and-sleeve type electrical connector used to capture a plug of the pin-and-sleeve electrical connector. The latch assembly has a housing with a cover, a plurality of latches and a corresponding plurality of latch lever arm extending from a latch lever, such that pivotable movement of the latch lever is translated to rotational movement of the latches between a plug capture position and a plug release position.

10 Claims, 20 Drawing Sheets

(56) References Cited

U.S. PATENT DOCUMENTS

| | | | | |
|---|---|---|---|---|
| 5,702,266 | A | 12/1997 | Jones | |
| 5,743,752 | A | 4/1998 | Massebeuf | |
| 5,897,387 | A | 4/1999 | Vallet et al. | |
| 5,944,550 | A | 8/1999 | Vindigni | |
| 5,980,278 | A | 11/1999 | Winkler | |
| 6,109,938 | A | 8/2000 | Meslet et al. | |
| 6,255,607 | B1 | 7/2001 | Miller | |
| 6,302,726 | B1 | 10/2001 | Marechal | |
| 6,319,042 | B2 | 10/2001 | Hirschmann | |
| 6,382,990 | B1 | 5/2002 | Marechal | |
| 6,410,868 | B1 | 6/2002 | Berlemont et al. | |
| 6,431,888 | B1 | 8/2002 | Crestin | |
| 6,479,773 | B2 | 11/2002 | Bienvenu | |
| 6,682,361 | B2 | 1/2004 | Zweigle | |
| 6,685,513 | B2 | 2/2004 | Bienvenu | |
| 6,786,754 | B2 | 9/2004 | Yamaoka et al. | |
| 6,825,417 | B2 | 11/2004 | Ball | |
| 6,890,006 | B2 | 5/2005 | Crestin | |
| 7,081,024 | B2 | 7/2006 | Karadimas et al. | |
| 7,147,518 | B2 | 12/2006 | Marechal et al. | |
| 7,182,614 | B2 | 2/2007 | Crestin | |
| 7,249,976 | B1 | 7/2007 | Watson | |
| 7,422,486 | B2 | 9/2008 | Hoff et al. | |
| 7,452,222 | B2 | 11/2008 | McInttire et al. | |
| 7,491,080 | B2 | 2/2009 | Alami | |
| 7,575,450 | B2 | 8/2009 | Williams et al. | |
| 7,811,115 | B1 | 10/2010 | Tyler | |
| D639,243 | S | 6/2011 | Gharib et al. | |
| 8,011,938 | B2 | 9/2011 | Martin et al. | |
| D648,271 | S | 11/2011 | Spilker et al. | |
| 8,092,240 | B2 | 1/2012 | Alami | |
| 8,105,106 | B1 | 1/2012 | Stoddard | |
| 8,211,150 | B2 | 7/2012 | Alami | |
| D667,791 | S | 9/2012 | Angel et al. | |
| D680,494 | S | 4/2013 | Hirakawa et al. | |
| D683,313 | S | 5/2013 | Hirakawa et al. | |
| D688,629 | S | 8/2013 | Spilker et al. | |
| D698,320 | S | 1/2014 | Condo et al. | |
| 8,772,655 | B2 | 7/2014 | Lee | |
| 9,252,539 | B2 * | 2/2016 | Condo | H01R 13/6456 |
| 9,368,911 | B2 * | 6/2016 | Charnesky | H01R 13/639 |
| 2012/0088393 | A1 | 4/2012 | Siebens | |
| 2014/0127926 | A1 * | 5/2014 | Condo | H01R 13/6456<br>439/345 |
| 2016/0141800 | A1 * | 5/2016 | Charnesky | H01R 13/639<br>439/312 |
| 2016/0156140 | A1 * | 6/2016 | Condo | H01R 13/6456<br>439/188 |

* cited by examiner

ELECTRICAL CONNECTOR WITH PLUG LATCHING ASSEMBLY

BACKGROUND

Field

The present disclosure relates to electrical connectors, and in particular to pin-and-sleeve type electrical connectors.

Description of the Related Art

Standard pin and sleeve devices typically have a male plug with contact pins and a female receptacle with mating sleeve-like contacts sometimes called contact sleeves. Some form of plug-to-receptacle latching is usually provided at least to minimize accidental separation of the male plug from the female receptacle. The electrical connection is made through the mechanical insertion of the contact pins in the male plug into the contact sleeves in the female receptacle. For safety, the receptacle's contact sleeves may not be energized or accessible until the plug and receptacle are properly coupled.

SUMMARY

The present disclosure provides a latch assembly for locking a plug to a receptacle in pin-and-sleeve type electrical connectors. In one exemplary embodiment, the latch assembly includes a housing, plurality of latches, a latch lever and a plurality of latch lever arms extending from the latch lever such that one latch lever arm is operatively coupled to one latch. The housing has a latch compartment and a latch lever compartment. The plurality of latches are positioned within the latch compartment of the cover and rotatable between a plug capture position and a plug release position. The latch lever is pivotably positioned at least partially within the latch lever compartment. In this configuration pivotable movement of the latch lever is translated to rotational movement of the latches between the plug capture position and the plug release position.

In another exemplary embodiment, the latch assembly includes a housing, first and second latches, a latch lever, and first and second latch lever arms extending from the latch lever such that the first latch lever arm is operatively coupled to the first latch, and the second latch lever arm is operatively coupled to the second latch. The housing has a latch compartment and a latch lever compartment, and the first and second latches are positioned within the latch compartment and rotatable between a plug capture position and a plug release position. The latch lever is pivotably positioned at least partially within the latch lever compartment. In this exemplary embodiment, the first latch lever arm extends into the latch compartment and is operatively coupled to the first latch, and the second latch lever arm extends into the latch compartment and is operatively coupled to the second latch. As such, pivotable movement of the latch lever can be translated to rotational movement of the first and second latches between the plug capture position and the plug release position.

The latch assembly of the present disclosure shortens the displacements and force required to release the plug from the receptacle. This is achieved by lessening the deflection requirements for the latches.

The present disclosure also provides pin-and-sleeve type electrical connectors that have a plug that can be coupled to a receptacle. The receptacle of the electrical connectors include the latch assembly described above.

BRIEF DESCRIPTION OF THE DRAWINGS

Embodiments of the invention are described in detail below, purely by way of example, with reference to the accompanying drawing figures, in which.

DETAILED DESCRIPTION

As used in this application, terms such as "front," "rear," "side," "top," "bottom," "above," "below," "upwardly" and "downwardly" are intended to facilitate the description of the electrical connector and latch assembly according to the present disclosure and are not to be construed as limiting the structure of the electrical connector and latch assembly to any particular position or orientation.

Figure 1:
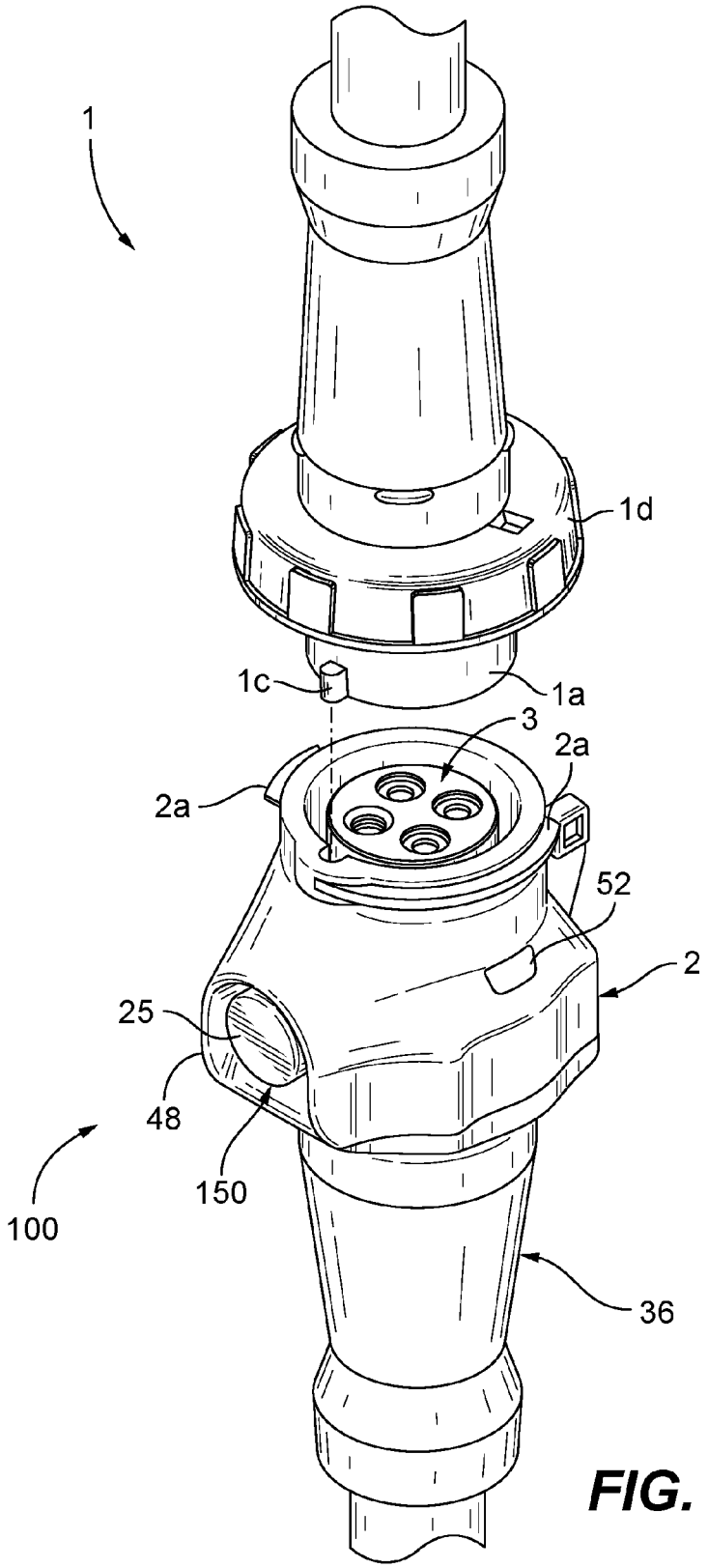
FIG. 1 is a perspective view of an exemplary configuration of an electrical connector according to the present disclosure, illustrating a plug and a receptacle.

Referring to FIG. 1, a male plug 1 for mating with a female receptacle 100 of a pin-and-sleeve type electrical connector is shown. As used in this application, the term plug relates to a male half of a pin-and-sleeve electrical connector, and the term "receptacle" relates to a female half of a pin-and-sleeve electrical connector regardless of how the receptacle is mounted, e.g., surface mounted, in-wall mounted or panel mounted, or how the receptacle is connected to a power source, e.g., connected to a power source via a cable. However, it should be readily appreciated that the plug may be a female half of the pin-in-sleeve electrical connector, and the receptacle may be a male half of the pin-in-sleeve electrical connector. A more detailed description of the components of an exemplary plug 1 and receptacle 100, except for the latching assembly described herein, are described in commonly owned U.S. Pat. No. 9,252,539, which is incorporated herein in its entirety by reference. A condensed description of the plug 1 and receptacle 100 follows.

Figure 2:
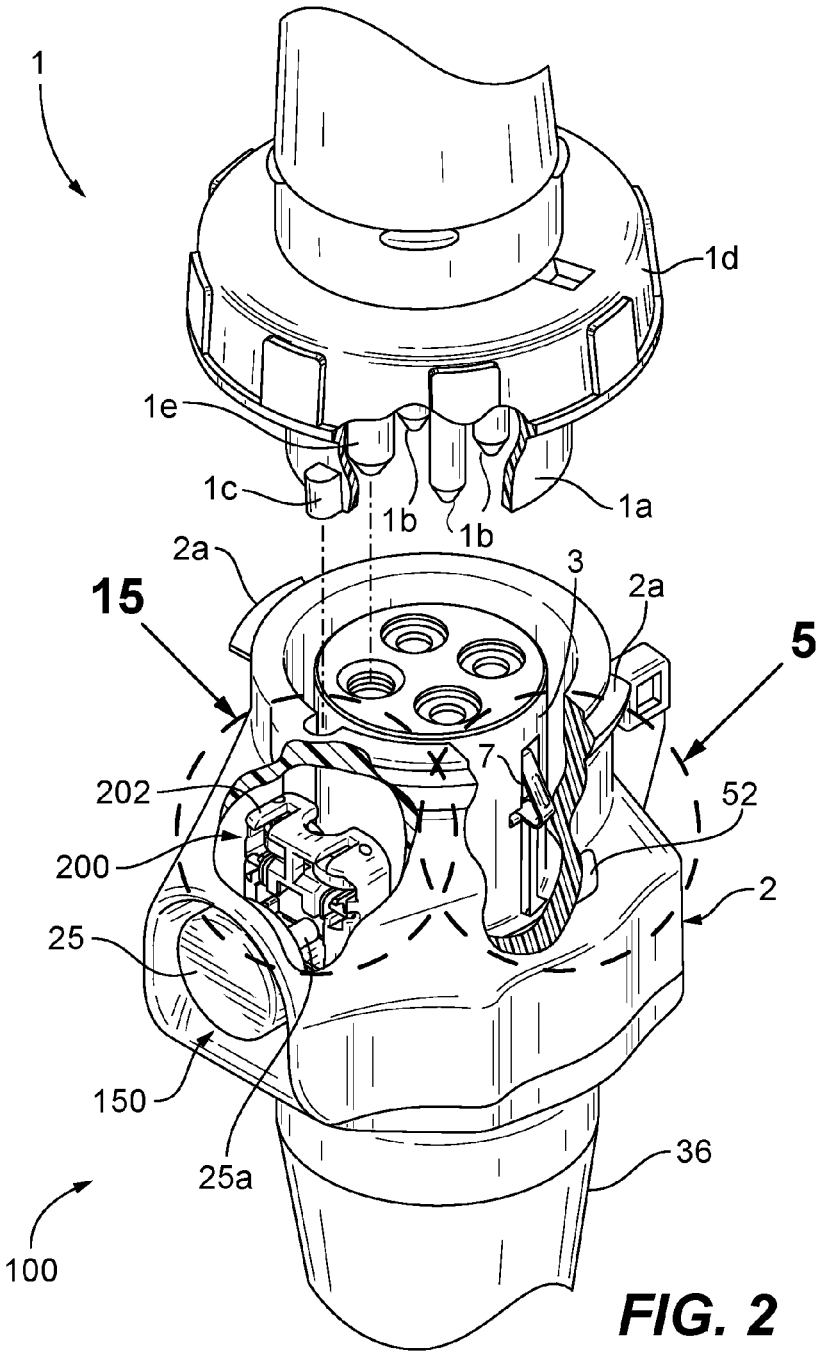
FIG. 2 is an enlarged perspective view of the electrical connector of FIG. 1 with a cut-out within the receptacle showing a latch assembly according to the present disclosure supported within the receptacle.
Figure 3:
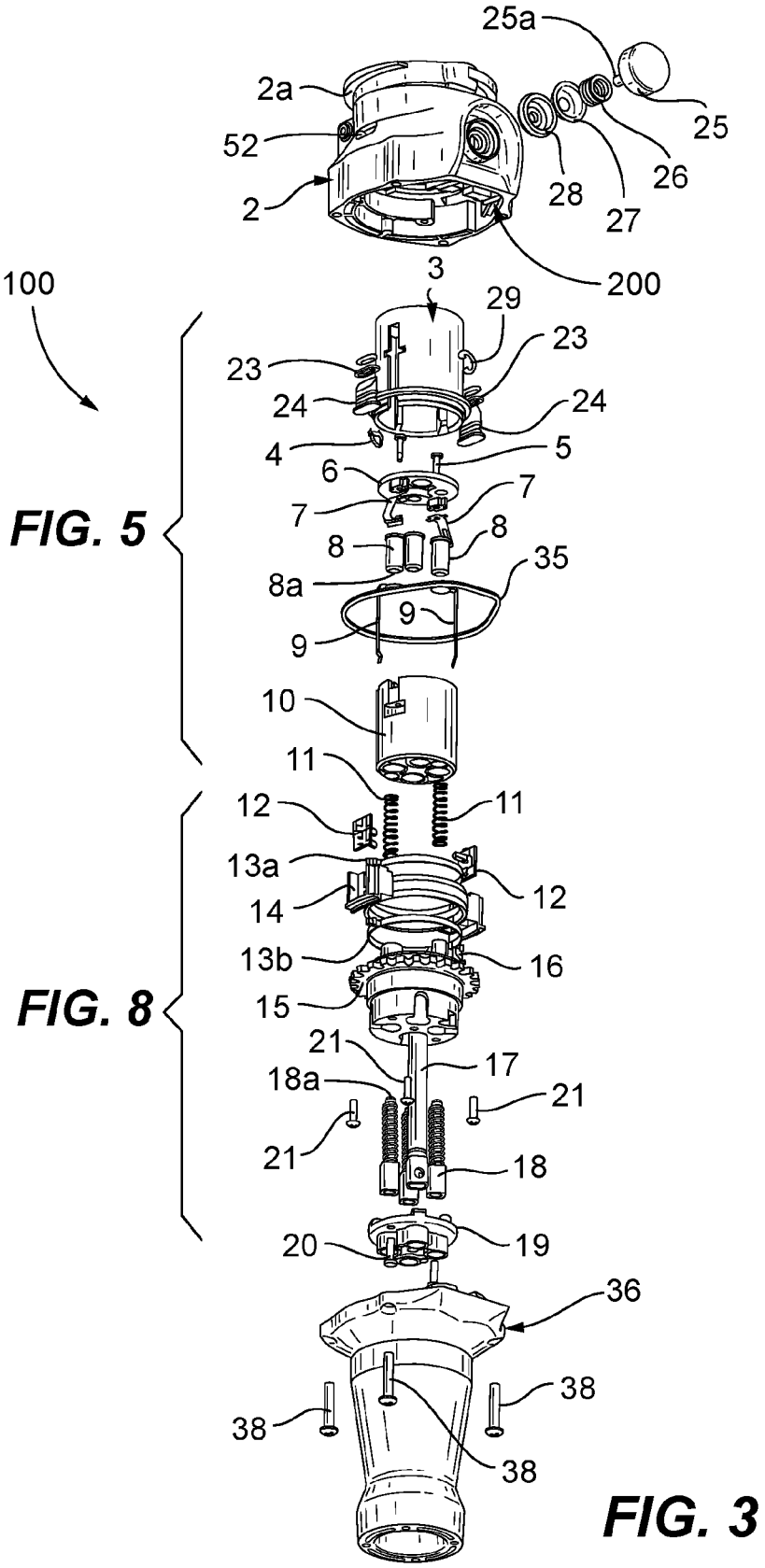
FIG. 3 is an exploded perspective view of the receptacle of FIG. 1.
Figure 4:
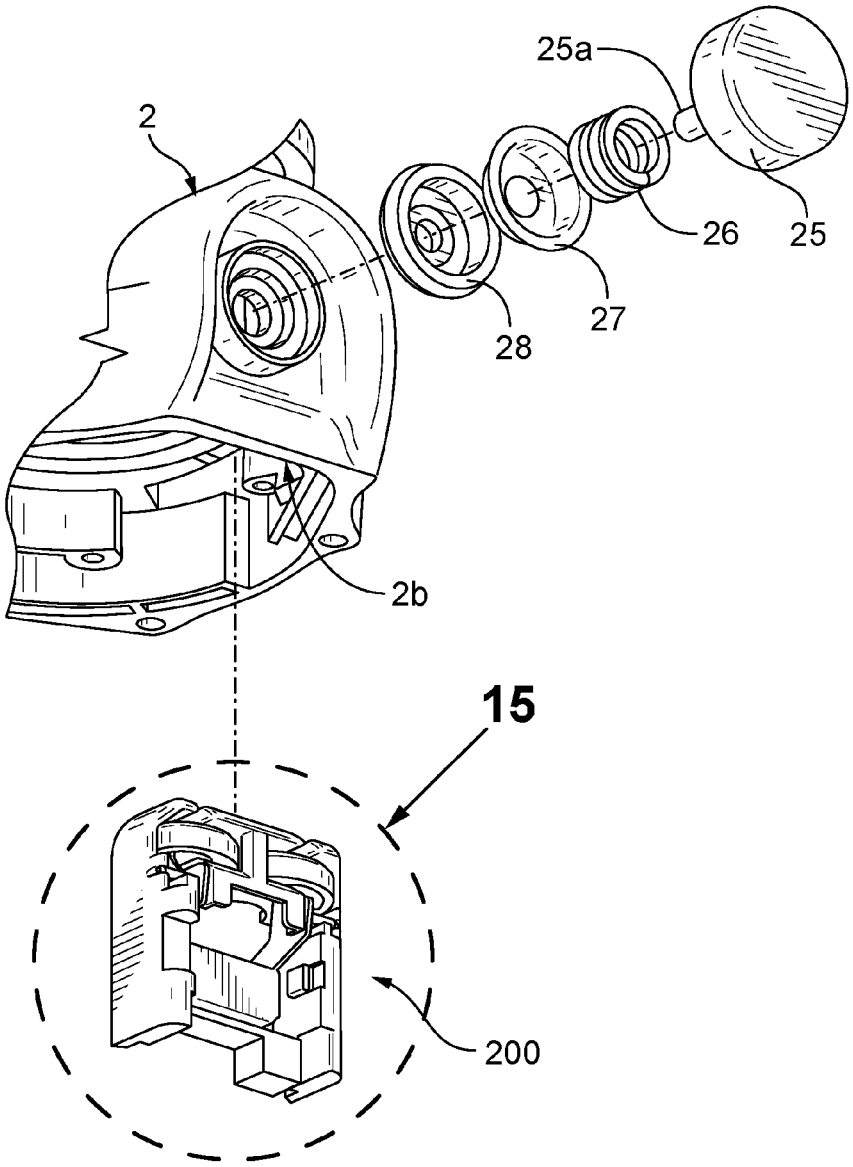
FIG. 4 is an enlarged view of a portion of an upper housing of the receptacle of FIG. 3 and showing the positioning of the latch assembly relative to the receptacle housing.
Figure 5:
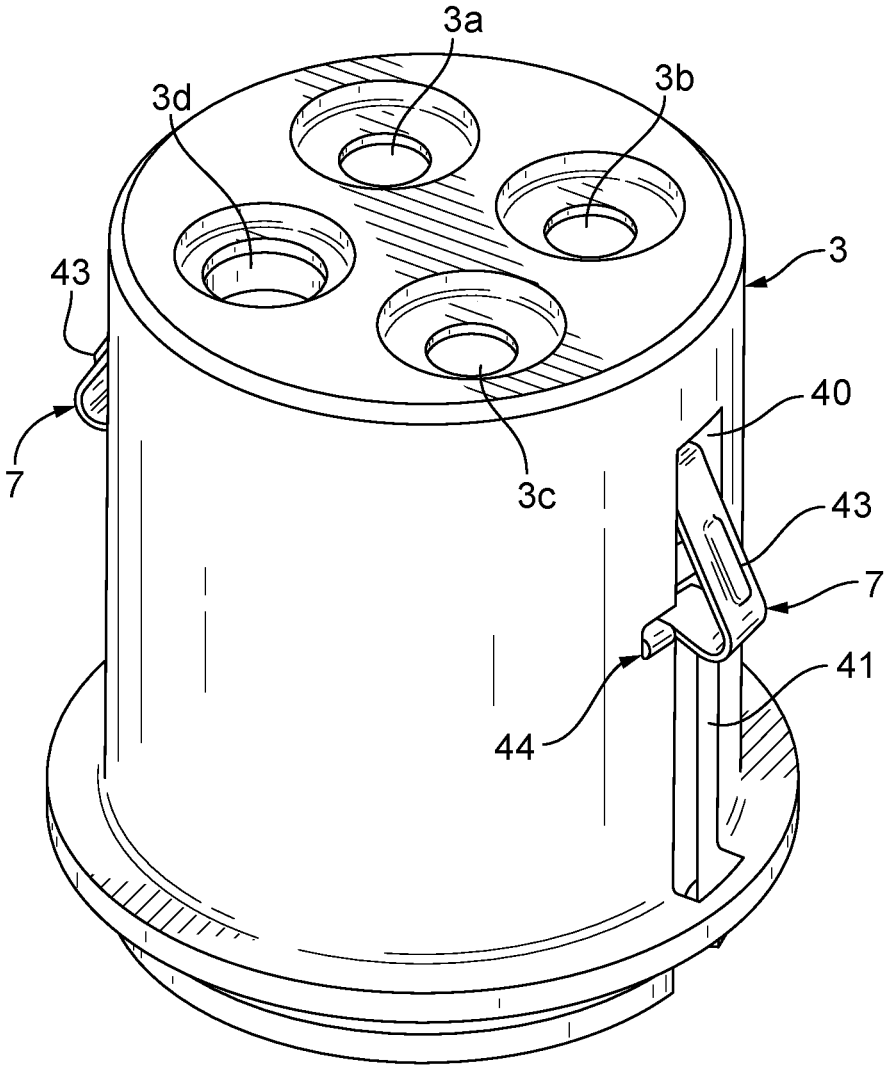
FIG. 5 is a perspective view of a sleeve carrier assembly of the receptacle of FIG. 3, illustrating two retaining mechanisms associated with the assembled sleeve carrier housing.
Figure 6:
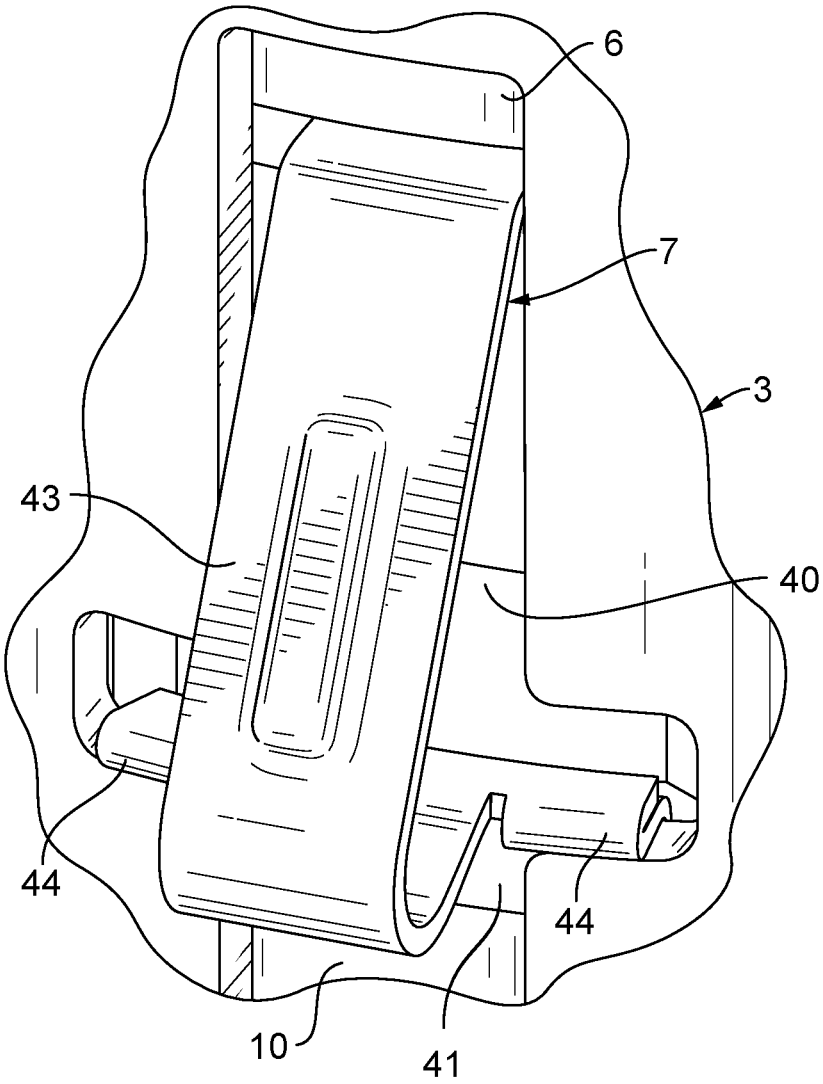
FIG. 6 is an enlarged perspective view of a retaining mechanism of the sleeve carrier assembly of FIG. 5.

Referring to FIGS. 2-4, the plug 1 has a cylindrical front safety shroud 1*a* surrounding a plurality of line contact pins 1*b* and a rotatable locking ring 1*d*. In some embodiments, the shroud 1*a* may also surround a ground contact pin 1*e*. The line contact pins 1*b* within the plug 1 are adapted to mate with contact sleeves 8 within sleeve carrier 10 in the receptacle 100. The ground contact pin 1*e* is adapted to mate with a ground sleeve assembly 17. The shroud 1*a* of the plug 1 has an integrally formed, radially projecting indexing rib 1*c* at its front end. The indexing rib 1*c*, which may be a tab, interacts with a latching assembly 200 of the receptacle 100 as will be described in more detail below. The rotatable locking ring 1*d* has two lugs (not shown) adapted to mate with two standard ramped locking flanges 2*a* at the front end of an upper housing 2 of the receptacle 100. A standard butted rubber gasket (not shown) seals the interface between the plug 1 and the receptacle 100 when they are fully mated.

Referring to FIG. 3, the receptacle 100 has an upper housing 2 and a lower housing 36. The lower housing 36 is secured to the upper housing 2 using, for example, screws 38 with an interposed sealing gasket 35 between the two housings. In one exemplary embodiment, the lower housing 36 can be configured for connection to a cable. In another exemplary embodiment, the upper housing 2 can be mated instead to various adapters (not shown) using screws to enable mounting of the receptacle 100 on a surface, in a wall, in a panel, etc. A sleeve carrier assembly according to the present disclosure is positioned within the receptacle 100 and includes a sleeve carrier housing 3, a sleeve carrier 10 with its internal components and a terminal retainer 15 with its internal components as described herein.

Figure 8:
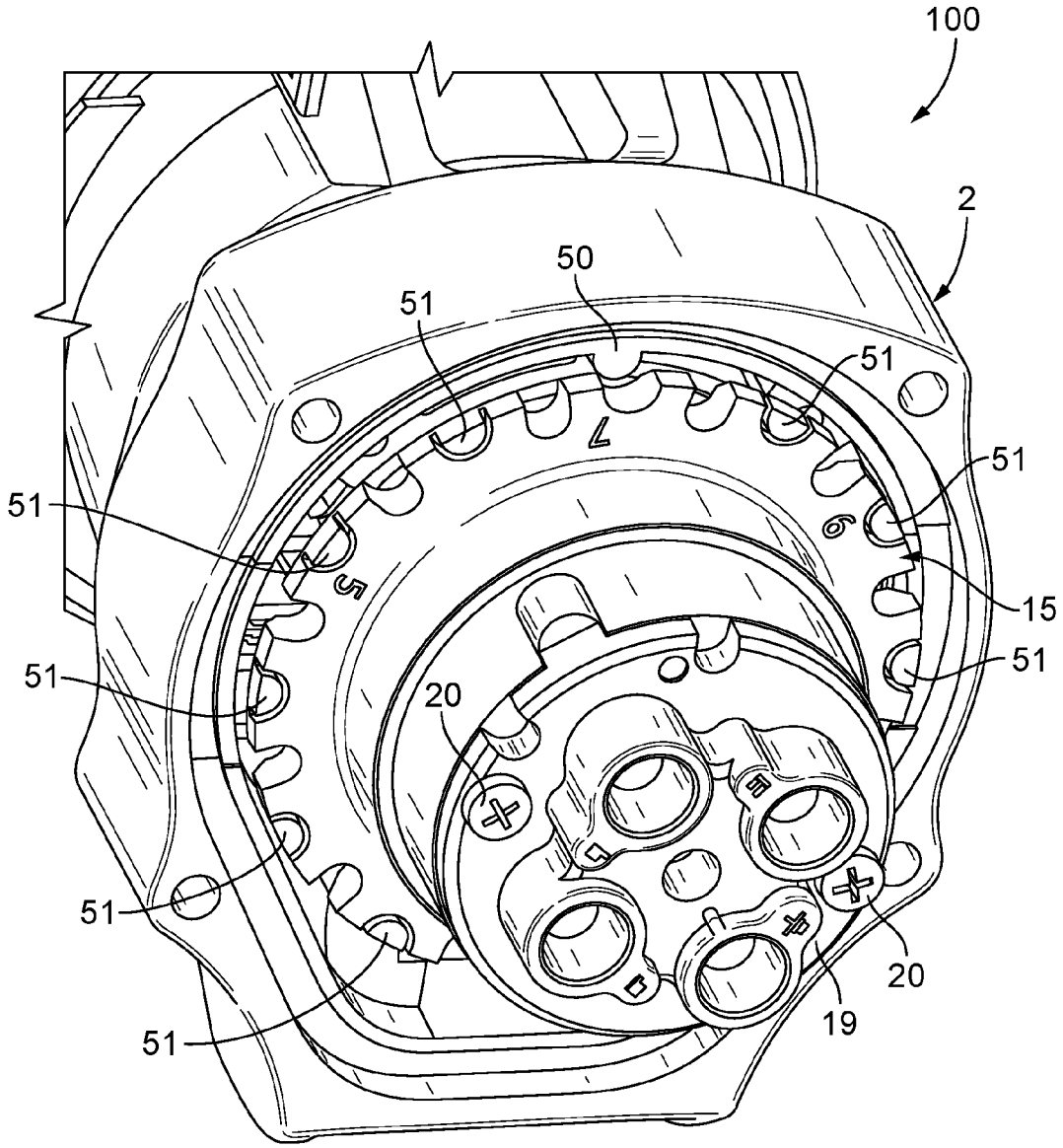
FIG. 8 is a bottom perspective view of a terminal retainer secured to an upper housing of the receptacle of FIG. 3.

Referring to FIGS. 3 and 8, an exemplary embodiment of a portion of the sleeve carrier assembly is shown. Three line contact sleeves 8 of this exemplary embodiment are fixed in the sleeve carrier 10 by a sleeve carrier cap 6 held in place by screws 5. The sleeve carrier 10 is positioned within the sleeve carrier housing 3 and axially movable within the sleeve carrier housing. The sleeve carrier housing 3 is fixed in place within the upper housing 2 of the receptacle 100 by abutting the terminal retainer 15 to the sleeve carrier housing and securing the terminal retainer within the upper housing 2 using mounting screws 21. Two helical carriage springs 11 are interposed between the sleeve carrier 10 and the terminal retainer 15 and used to bias the sleeve carrier 10 away from the pressure contacts 18.

Referring now to FIGS. 3 and 9-11, the three contact sleeves 8 have inwardly facing electrical contact tips 8*a* that are axially movable into and out of engagement with a corresponding electrical contact tip 18*a* of an equal number of braided, spring-loaded contact terminals 18. The contact terminals 18 may also be referred to herein as "pressure contacts." The contact tips 8*a* and 18*a* may be silver contact tips. The pressure contacts 18 are conventional electrical contacts, examples of which are described in U.S. Pat. No. 4,176,905, which is incorporated herein in its entirety by reference. The pressure contacts 18 are supported in a terminal retainer 15 by a terminal retainer cap 19 fastened to the terminal retainer 15 by screws 20. The terminal retainer 15 is secured to the upper housing 2 using screws 21, as noted above, to secure the carrier sleeve assembly within the receptacle 100.

Referring to FIGS. 3, 5, 9 and 12, the receptacle 100 may also include a continuous ground configuration that ensures grounding of the primary electrical circuit when inserting and withdrawing the plug 1 relative to the receptacle 100. In embodiments where a continuous ground configuration is provided, a ground sleeve assembly 17 is fixed in the terminal retainer 15 and extends freely through sleeve carrier 10 where a distal end 17*a* of the ground sleeve assembly 17 begins to mate with a ground contact pin 1*e* of a plug 1 upon initial insertion of the plug into the receptacle 100 and before the line contact sleeves 8 mate with their respective line contact pins 1*b*. In this exemplary embodiment, the ground sleeve assembly 17, unlike the line contact sleeves 8, is not supported in or moved by sleeve carrier 10 and has no electrical contact tip on its inner end. Thus, the sleeve carrier 10 moves along the fixed ground sleeve assembly 17 such that the ground connection between the plug 1 and the receptacle 100 does rely on a pressure contact. Upon withdrawal of the plug 1 from the receptacle 100, the ground contact pin 1*e* of the plug 1 is the last contact pin to disengage from the ground sleeve assembly 17 maintaining an electrical path to ground during withdrawal of the plug 1 from the receptacle 100.

Figure 7:
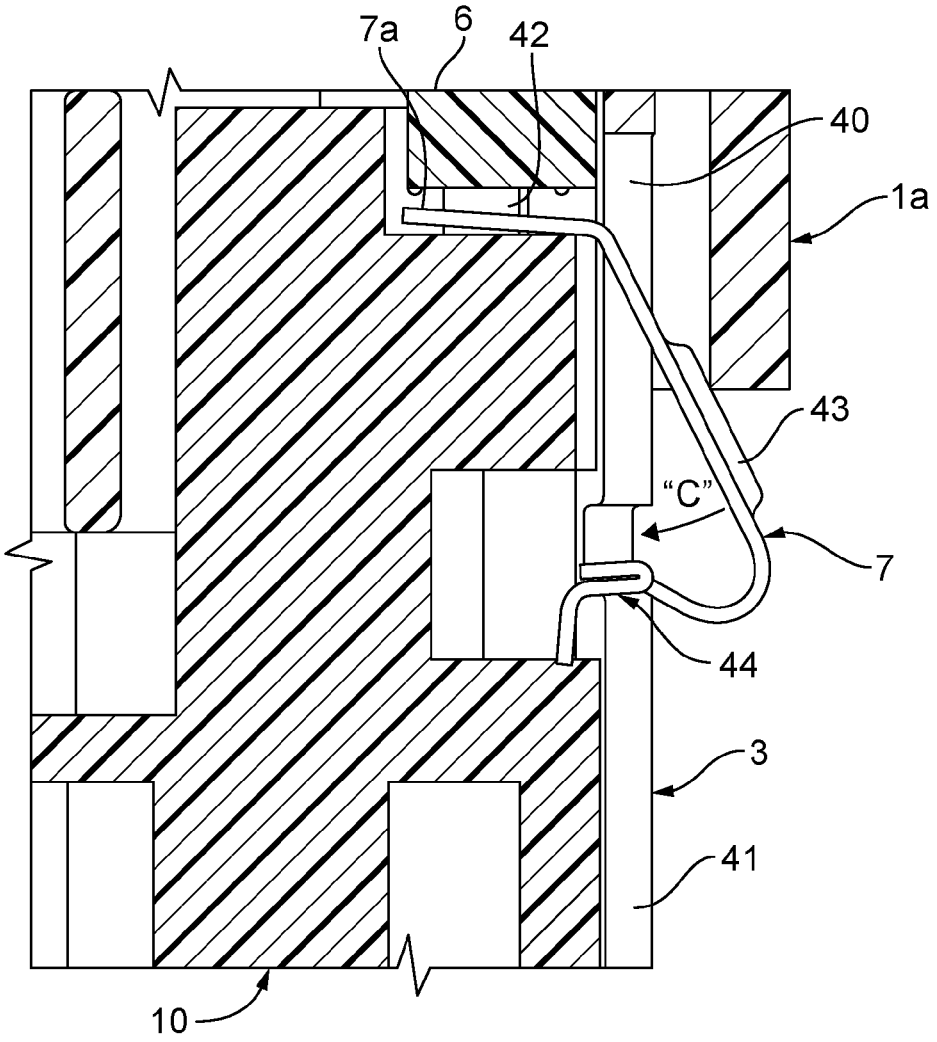
FIG. 7 is a sectional view of a portion of the sleeve carrier assembly of FIG. 5 in the area of one retaining mechanism.

Referring now to FIGS. 3 and 5-7, the sleeve carrier 10 is positioned within the sleeve carrier housing 3 and axially movable within the sleeve carrier housing as noted above. The sleeve carrier housing 3 has two diametrically opposed windows 40, seen in FIG. 5, that join respective narrower longitudinal slots 41 extending from the respective window 40 toward the terminal retainer 15. The upper end 7*a* of two inwardly deflectable resilient retaining clips 7 are anchored in respective recesses 42 in the sleeve carrier 10, as shown in FIG. 7. Each retaining clip 7 has an inclined, ribbed ramp portion 43 and a pair of lateral wings or shoulders 44. The retaining clips 7 may include a cover made of a thermoplastic material, such as Polyoxymethylene which may be sold for example under the name Delrin®. When the retaining clips 7 are in a relaxed state (not deflected), the ramp portions 43 project outward through their respective window 40 in the carrier housing 3 and the shoulders 44 engage the lower edges of their respective window 40, as shown in FIG. 7. In this relaxed state, the shoulders 44 of the retaining clips 7 prevent downward movement of the sleeve carrier 10 relative to the carrier housing 3 keeping the contact sleeves 8 separated from the pressure contacts 18 (seen for example in FIG. 10). In addition, in the relaxed state the ramp portions 43 of the retaining clips 7 project into the path traveled by the plug shroud 1*a* of the plug 1 when the plug is mated with the receptacle 100.

Figure 9:
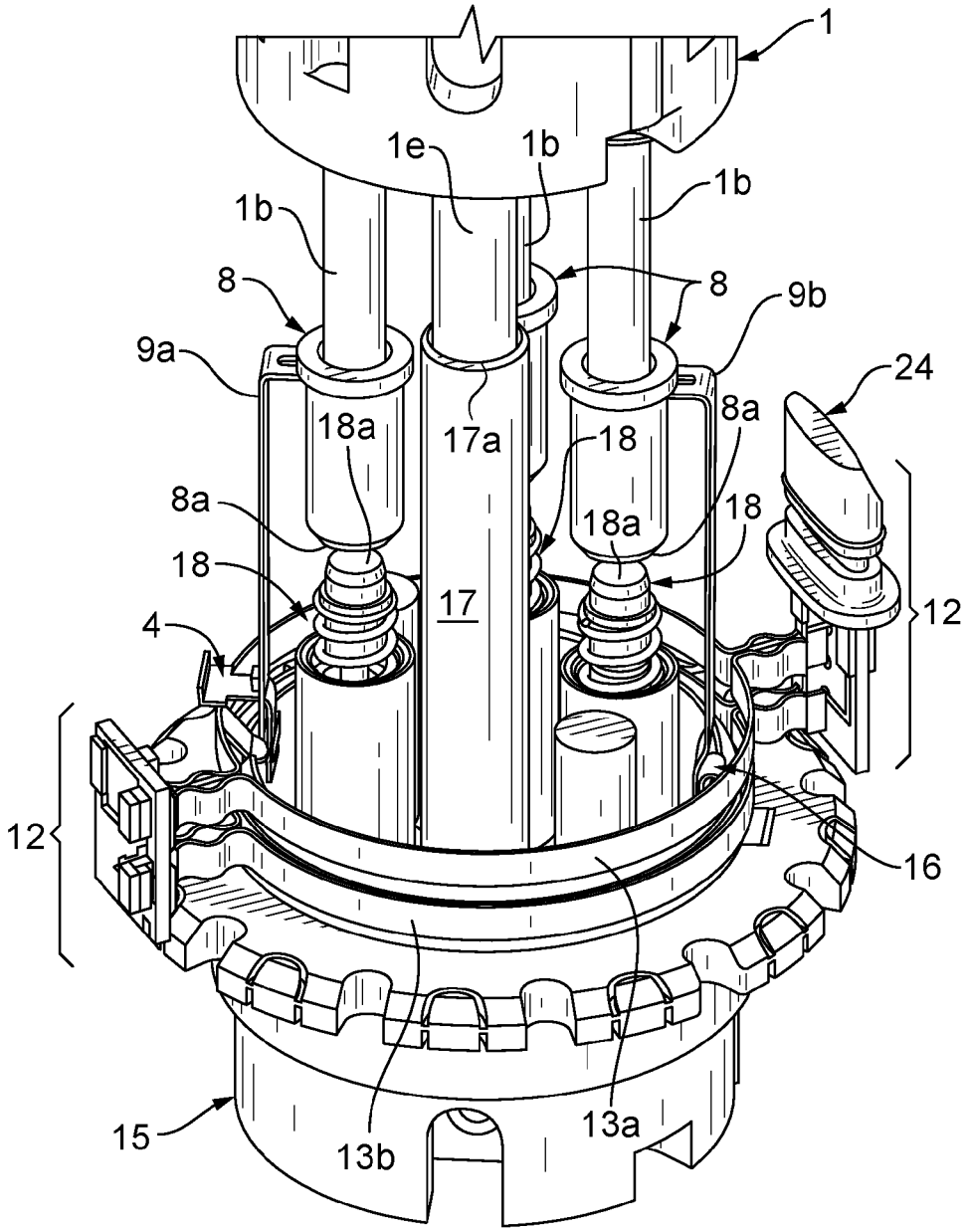
FIG. 9 is a perspective view of a portion of the plug of FIG. 2 and receptacle of FIG. 3 with parts removed to show pin contacts of the plug mating with contact sleeves of the sleeve carrier assembly and to show status indicator assemblies.
Figure 10:
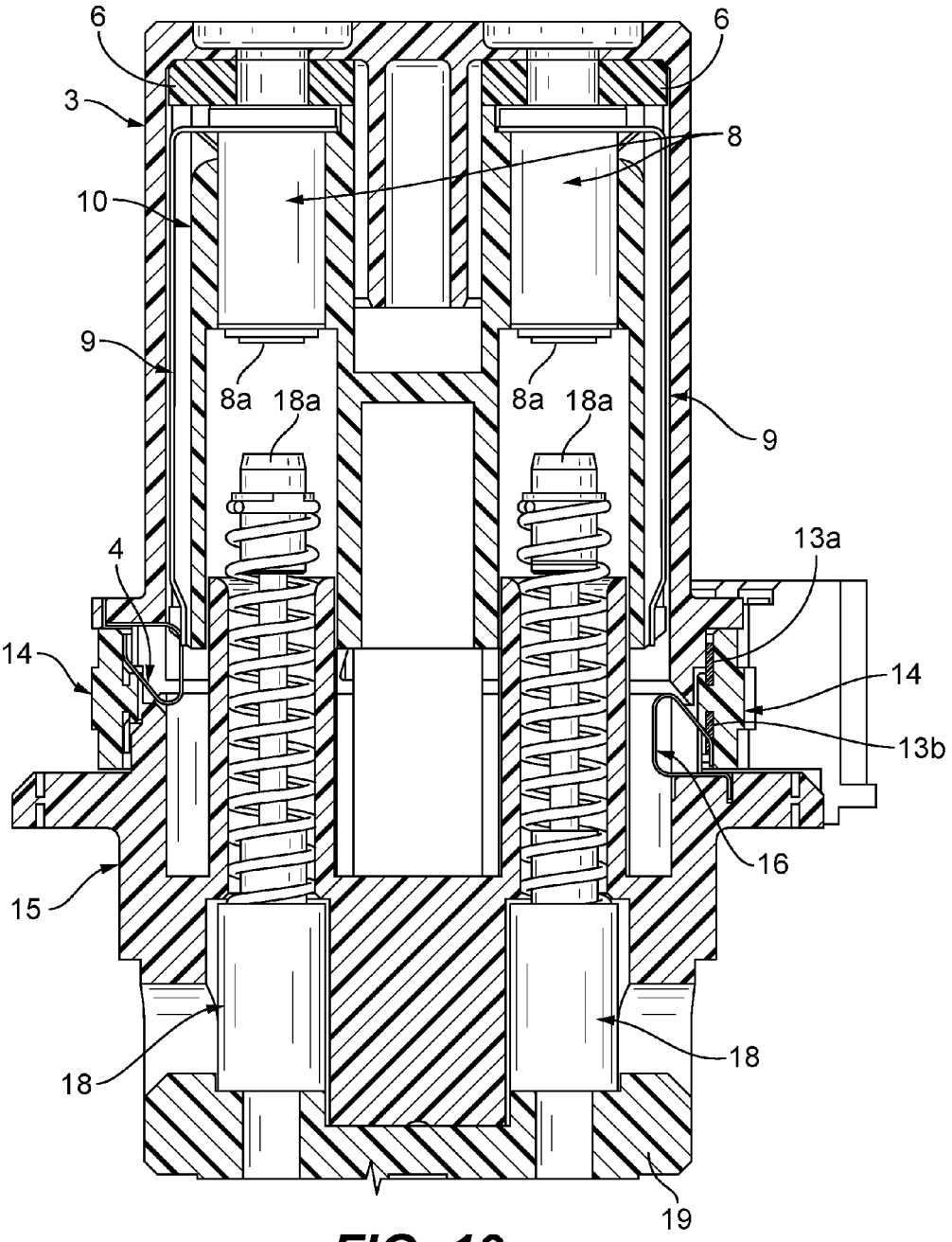
FIG. 10 is a sectional view through the sleeve carrier assembly of the receptacle of FIG. 3 showing the contact sleeves separated from corresponding contact terminals.

Turning now to FIGS. 8 and 9, the receptacle 100 also includes a modular clocking design that enables variable angular positioning of the terminal retainer 15 within the upper housing 2 so that a variety of terminal contact configurations can be achieved when manufacturing the receptacle 100 without having to stock differently configured terminal retainers. In the exemplary embodiment shown, the upper housing 2 has a clocking key 50 facing the periphery of terminal retainer 15, which has a plurality of peripheral clocking knockouts 51. The appropriate clocking knockout 51 is broken out during assembly of the receptacle 100 depending on the terminal configuration specified for the unit. In this way, the terminal retainer 15 and thus the pressure contacts 18 can be adjusted to align with the line contact sleeves 8 and the contact sleeve openings 3*a*, 3*b* and 3*c* in the sleeve carrier housing 3, seen in FIG. 5, and the ground sleeve assembly 17 can be aligned with the ground contact opening 3*d* in the sleeve carrier housing.

Referring to FIGS. 3 and 9, the receptacle 100 may also include a status indicator assembly that uses the primary power circuit to power a low-current lighting control circuit. The status indicator assembly includes first and second bridge connectors 9*a* and 9*b*, top and bottom connection clips 4 and 16, top and bottom cylindrical contact rings 13*a* and 13*b*, contact ring holders 14 and printed circuit board (PCB) assemblies 12. The first bridge connector 9*a* is connected at one end to a line contact sleeve 8 and at another end to the top connection clip 4. The top connection clip 4 is connected to the top contact ring 13*a* thus forming an electrically conductive path between the line contact sleeve 8 and the top contact ring 13*a*. Similarly, the second bridge connector 9*b* is connected at one end to another line contact sleeve 8 and at another end to the bottom connection clip 16. The bottom connection clip 16 is connected to the bottom contact ring 13*b* thus forming an electrically conductive path between the line contact sleeve 8 and the bottom contact ring 13*b*. The contact rings 13*a* and 13*b* can be cylindrical rings that may be of unitary construction or that may have two halves. Each contact ring 13*a* and 13*b* is held in place on the terminal retainer 15 using contact ring holder 14. Each PCB assembly 12 may be a plug-in type PCB that includes an integral LED or other lighting element and a lighting control circuit to illuminate the LED. The PCB is held in place by the contact ring holder 14 and the lighting control circuit on the PCB is connected to and supported by the top and bottom contact rings 13*a* and 13*b*. Each PCB assembly 12 also includes an LED lens 24 and an interposed lens gasket 23, seen in FIGS. 3 and 9. In this exemplary embodiment, closure of the primary electrical circuit occurs upon the full engagement of the plug 1 to the receptacle 100. Closure of the primary electrical circuit also completes the lighting control circuit energizing the LEDs. The illuminated LEDs are visible through observation windows 52 on opposite sides of upper housing 2, seen in for example FIGS. 1 and 3, providing a visual indication that power is being supplied between the plug 1 and the receptacle 100.

Referring again to FIGS. 2-4, the receptacle 100 also includes a pushbutton assembly 150 having a pushbutton 25 that is sealed to the upper housing 2 by a button seal cup 27 and a button lip seal 28. The pushbutton 25 has a pushbutton pin 25*a* that passes through a spring 26, the button seal cup 27, the button lip seal 28 and extends through the upper housing 2 into a latch assembly pocket 2*b* in the upper housing, as seen in FIG. 2. The spring 26 normally biases the pushbutton 25 away from the upper housing 2. The pushbutton assembly 150 is surrounded on three sides by a U-shaped rim 48 integrally formed into the upper housing 2. The rim 48 protects the pushbutton assembly 150 from damage while providing sufficient space in the recess around the pushbutton 25 to keep dust and debris from accumulating in that region.

The latch assembly pocket 2*b* in the upper housing 2 supports a latching assembly 200 that interacts with the indexing rib 1*c* of the plug 1 and the pushbutton assembly 150 during coupling and decoupling of the plug 1 relative to the receptacle 100. The latching assembly 200 selectively permits or inhibits decoupling movement of the plug 1 relative to the receptacle 100, and may provide a positive and audible engagement of the plug 1 as it mates with the receptacle 100. A more detailed description of the latching assembly 200 according to the present disclosure and its operation will be described.

Figure 13:
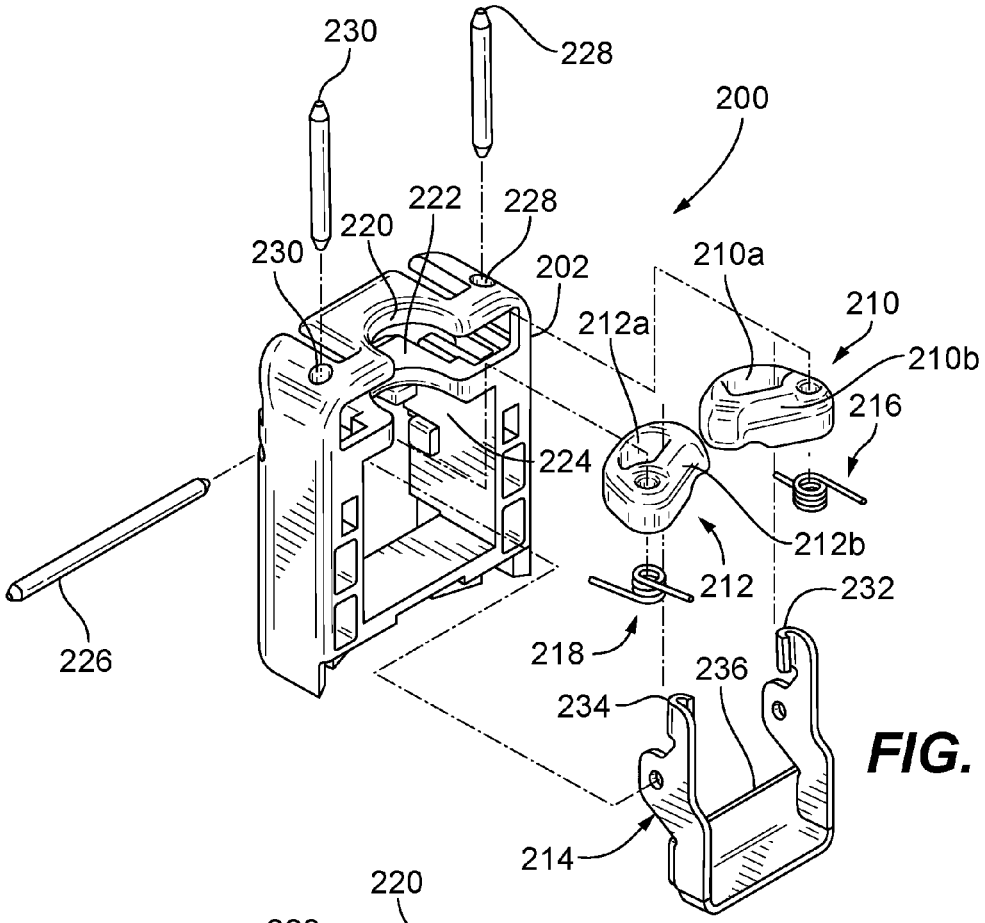
FIG. 13 is an exploded perspective view of the latch assembly according to the present disclosure.

Referring to FIGS. 2 and 13, an exemplary configuration of the latch assembly 200 of the present disclosure is shown. The latch assembly 200 includes a latch assembly housing 202, a pair of rotating (or pivoting) latches 210 and 212, and latch lever 214. The latch assembly housing 202 is supported within the pocket 2*b* of the upper housing 2, as noted above and as shown in FIG. 4. The latch assembly housing 202 has a latch compartment 222 configured to receive the latches 210 and 212 and corresponding springs 216 and 218. The latch assembly housing 202 also has a latch lever compartment 224 configured to receive the latch lever 214. The latch assembly housing 202 also has an indexing rib portal 220 that provides an entry to the latch compartment 222 and the latch lever compartment 224.

Figure 14:
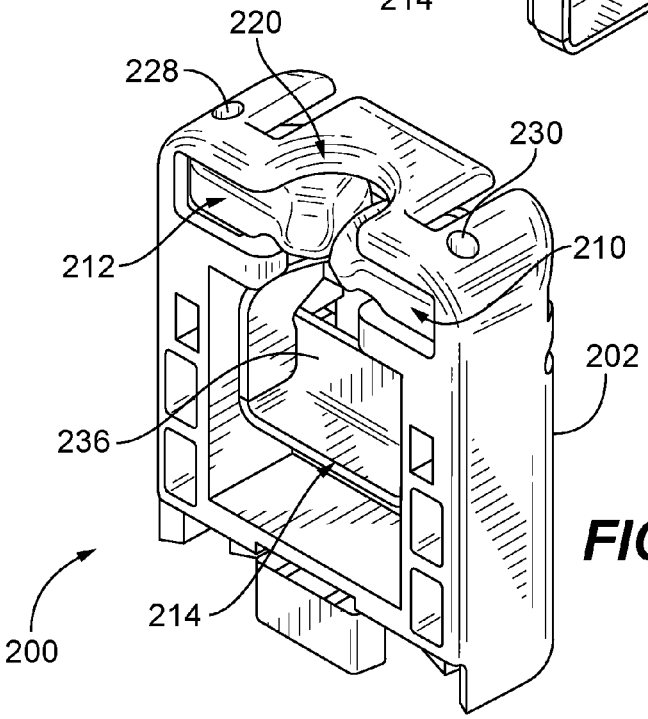
FIG. 14 is a rear perspective view of the latch assembly of FIG. 13 with the latch assembly in a plug capture position where movable latches block an indexing rib portal.
Figure 15:
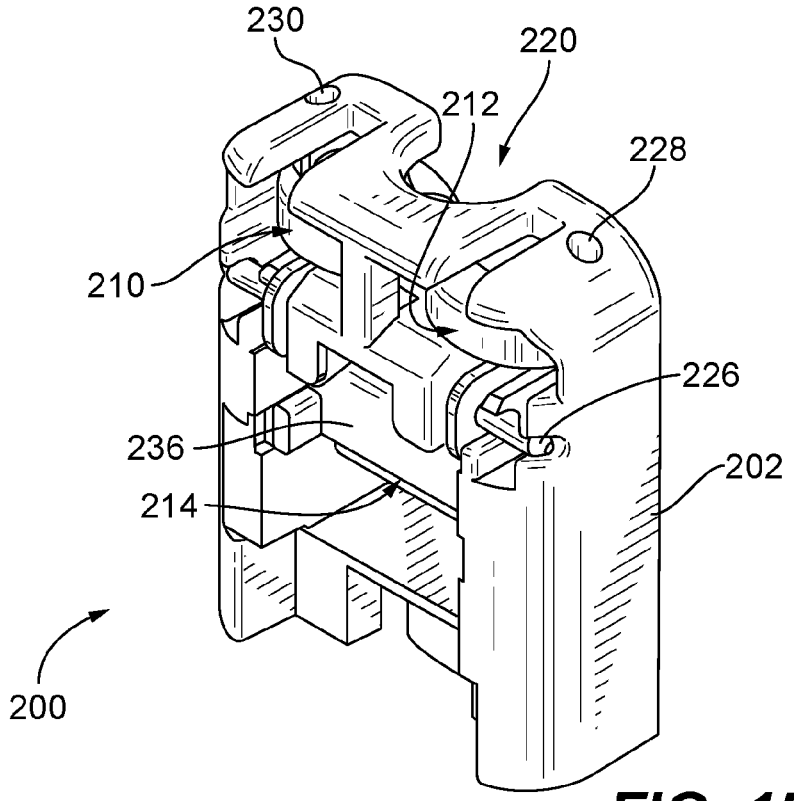
FIG. 15 is a front perspective view of the latch assembly of FIG. 14.
Figure 16:
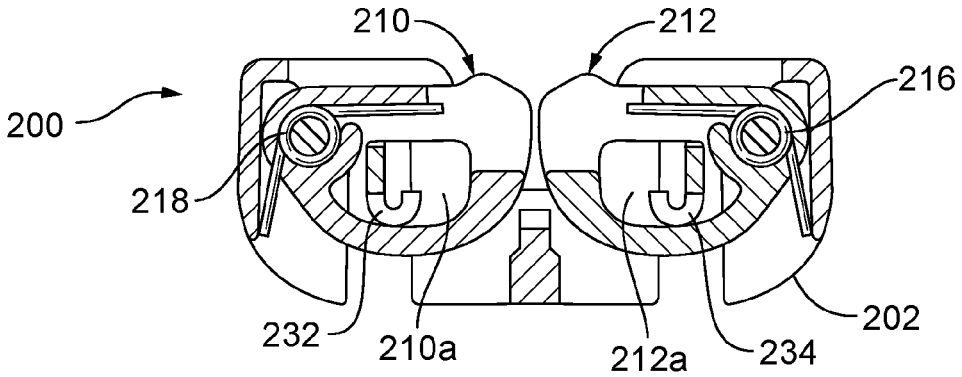
FIG. 16 is a top sectional view of the latch assembly of FIG. 14.
Figure 17:
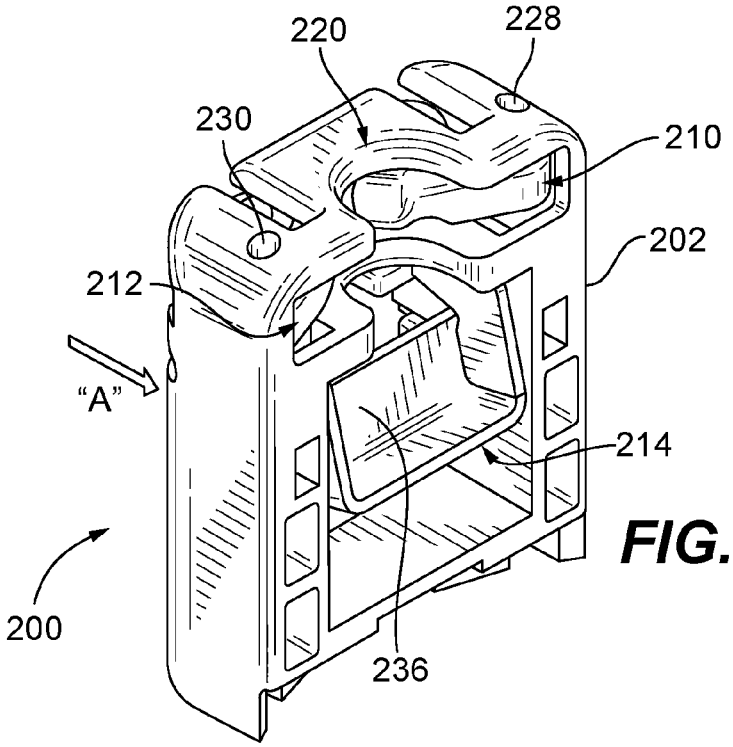
FIG. 17 is a rear perspective view of the latch assembly according of FIG. 13 with the latch assembly in a plug release position where the movable latches do not block the indexing rib portal.
Figure 18:
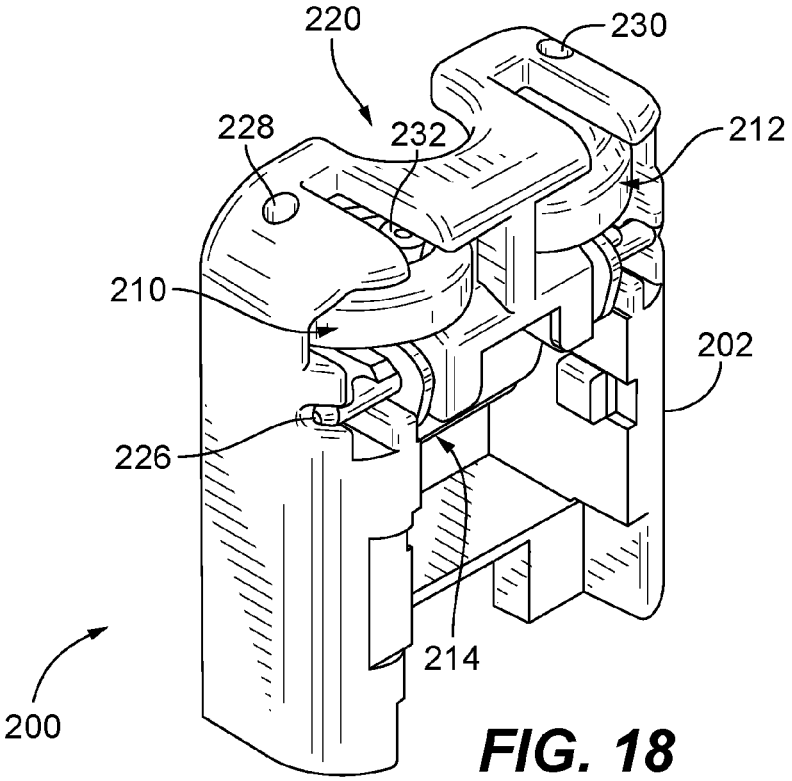
FIG. 18 is a front perspective view of the latch assembly of FIG. 17.
Figure 19:
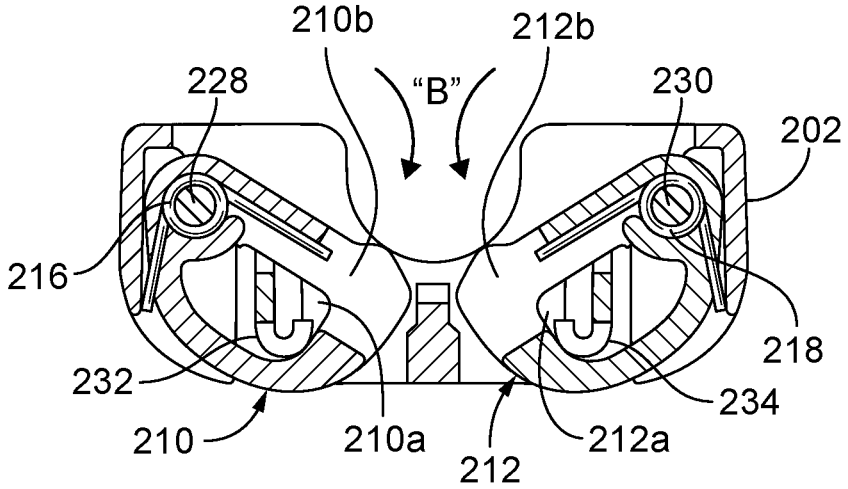
FIG. 19 is a top sectional view of the latch assembly of FIG. 17.

The latch 210 is secured within the latch compartment 222 using latch pivot pin 228 so that the latch 210 can rotate between the plug capture position, seen in FIGS. 14-16, and the plug release position, seen in FIGS. 17-19. Similarly, the latch 212 is secured within the latch compartment 222 using latch pivot pin 230 so that the latch 212 can rotate between the plug capture position and the plug release position. The latches 210 and 212 are normally biased inwardly by the respective springs 216 and 218 toward the plug-capture position, i.e., in a direction so that the latches 210 and 212 extend within the path of an indexing rib portal 220, as seen in FIGS. 14-16.

The latch lever 214 is secured within the latch lever compartment 224 using latch lever pin 226 so that the latch lever 214 is pivotable within the latch lever compartment 224 relative to the latch assembly housing 202. The latch lever 214 includes latch lever arms 232 and 234, and a latch lever push bar 236. Latch lever arm 232 passes through the latch lever compartment 224 into the latch compartment 222 and fits within aperture 210*a* in latch 210. Similarly, the latch lever arm 234 passes through the latch lever compartment 224 into the latch compartment 222 and fits within aperture 212*a* in latch 212. As a result, pivotable movement of the latch lever 214 caused when a force is applied to the latch lever push bar 236 is translated to rotational movement of the latches 210 and 212.

As noted above, the latch 210 is normally biased toward the plug capture position by torsion spring 216, and the latch 212 is normally biased toward the plug-capture position by torsion spring 218, as seen in FIG. 16. The latch assembly 200 of the present disclosure reduces the force to be applied to the pushbutton 25 and the pushbutton stroke deflection in order to decouple the plug 1 from the receptacle 100. As an example, the force needed to decouple the plug 1 from the receptacle 100 can, for example, range from about 10 lbs. to about 25 lbs. Further, the deflection stroke of the pushbutton 25 which translates pivotable movement of the latch lever 214 to rotational movement of the latches 210 and 212 minimizes the angle of rotation of the latches sufficient to unblock the indexing rib portal 220. For example, an angle of rotation of each latch 210 and 212 can be, for example, less than 25 degrees of rotation, and preferably less than 15 degrees of rotation for each latch in order to unblock the indexing rib portal 220 so that the indexing rib 1*c* can pass through the latching assembly 200.

Mechanical and electrical coupling and decoupling of the plug 1 relative to the receptacle 100 is accomplished by axial motion of the plug as it is inserted into or withdrawn from the receptacle 100. Inward axial motion of the plug 1 into the receptacle 100 triggers a sequence of movements of the internal components within the receptacle 100 to first mechanically couple the plug 1 to the receptacle 100 and then electrically couple the plug 1 to the receptacle 100. More specifically, as the line contact pins 1*b* and the ground contact pin 1*e* of the plug 1 are pressed into the receptacle 100, the ground contact pin 1*e* first engages the ground sleeve assembly 17. Further mating of the plug 1 with the receptacle 100 causes the line contact pins 1*b* to mate with and press into the respective contact sleeves 8 of the receptacle 100. With this mechanical coupling of the plug 1 to the receptacle 100, the contact sleeves 8 and the sleeve carrier 10 are held in position relative to the sleeve carrier housing 3 by the retaining clips 7, even as the leading edge of the plug shroud 1*a* begins to deflect the clips radially inward in the direction of arrow "C", as seen FIG. 7. When the line contact pins 1*b* of the plug 1 are substantially fully seated in the contact sleeves 8 the retaining clips 7 have been deflected by the shroud 1*a* of the plug 1 to the point that the shoulders 44 of the clips 7 have cleared the edges of the windows 40 in the sleeve carrier housing 3, freeing the sleeve carrier 10 to move downward relative to the sleeve carrier housing 3 in the direction of the pressure contacts 18.

Figure 11:
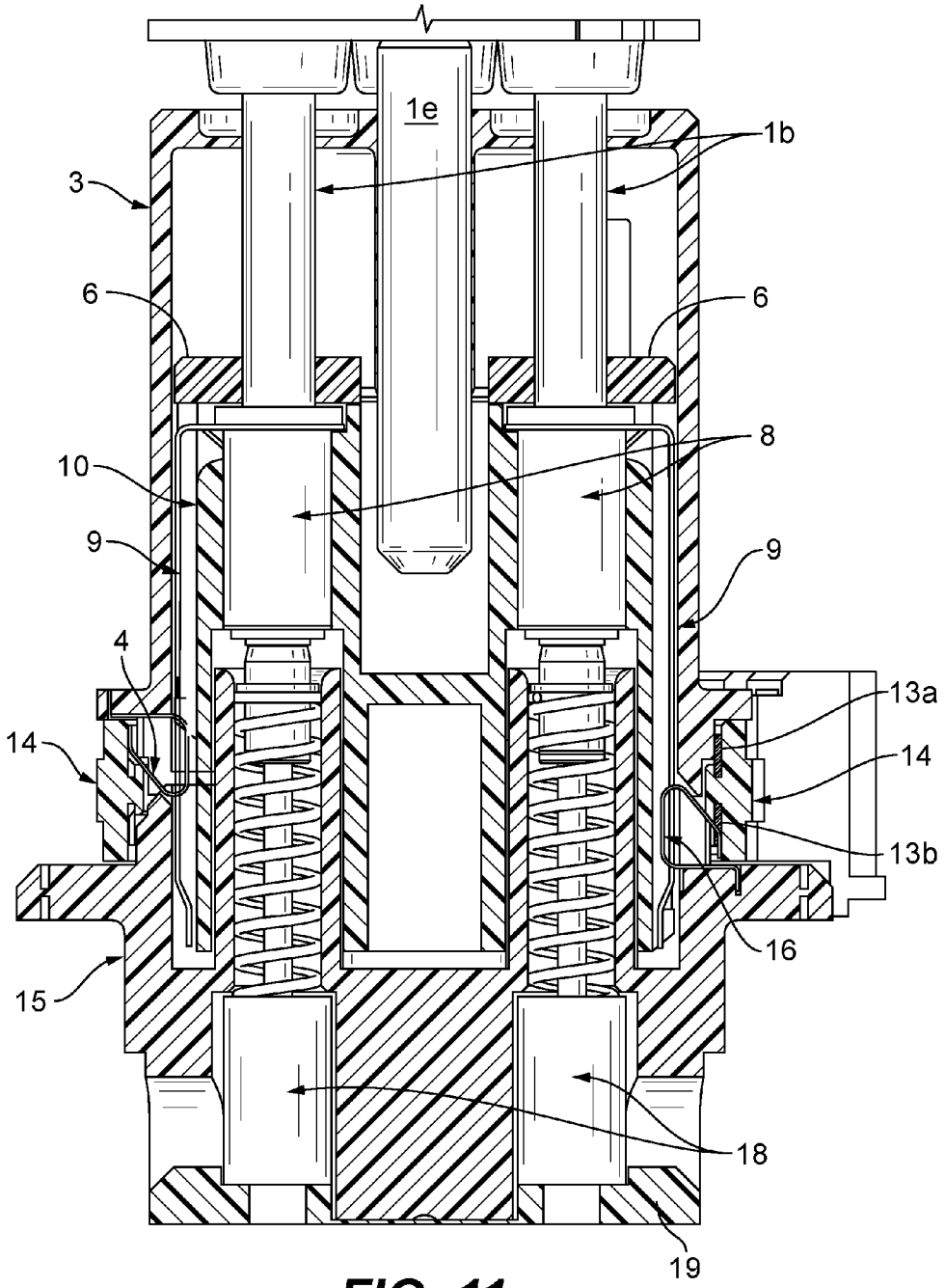
FIG. 11 is a sectional view through the sleeve carrier assembly similar to FIG. 10 and showing the contact sleeves engaging the corresponding contact terminals.
Figure 12:
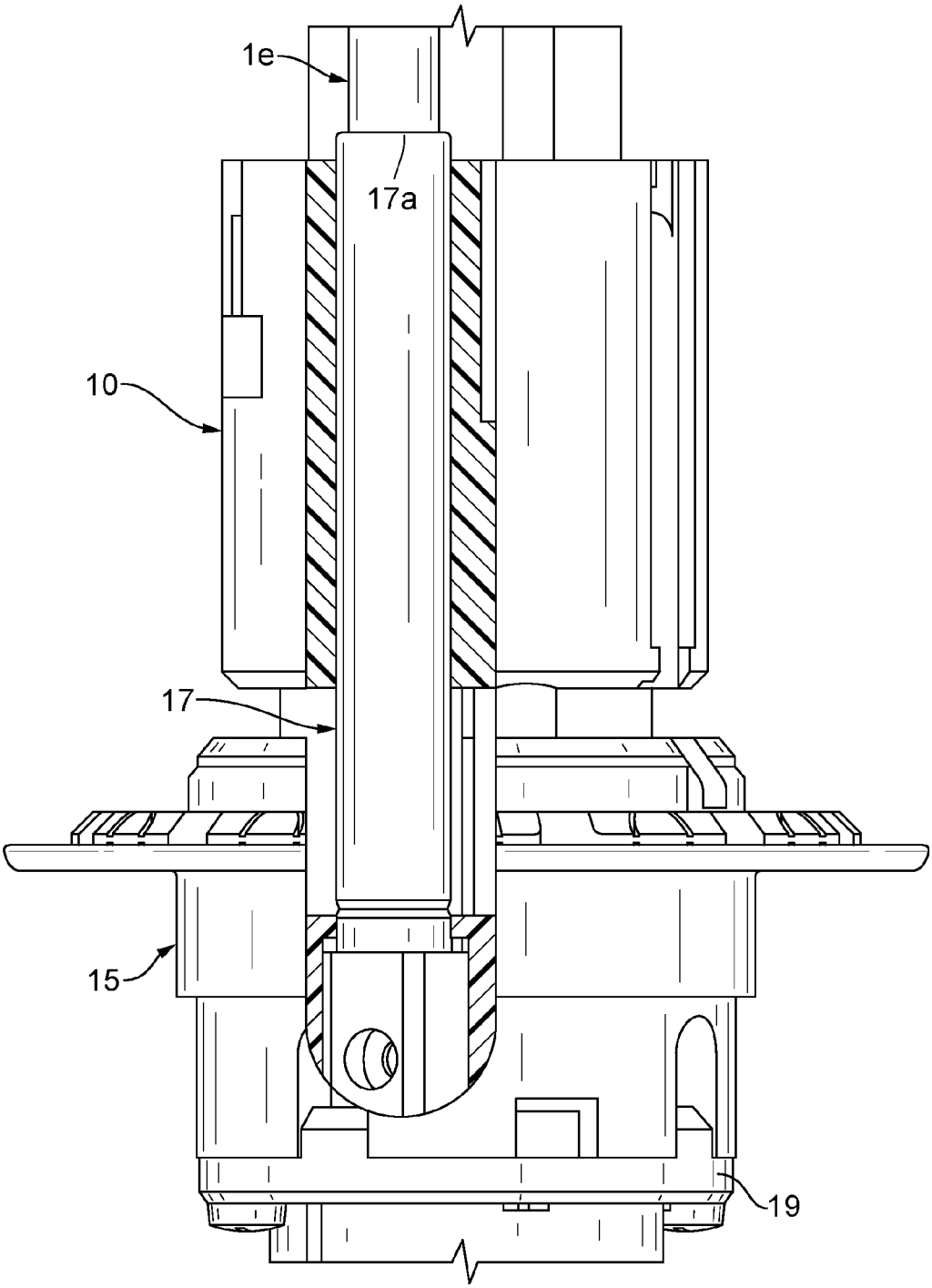
FIG. 12 is a side elevational view in partial cross-section of the sleeve carrier assembly of the receptacle of FIG. 3 and a portion of the plug of FIG. 1, showing a ground contact pin of the plug mating with a ground sleeve assembly of the receptacle.
Figure 20:
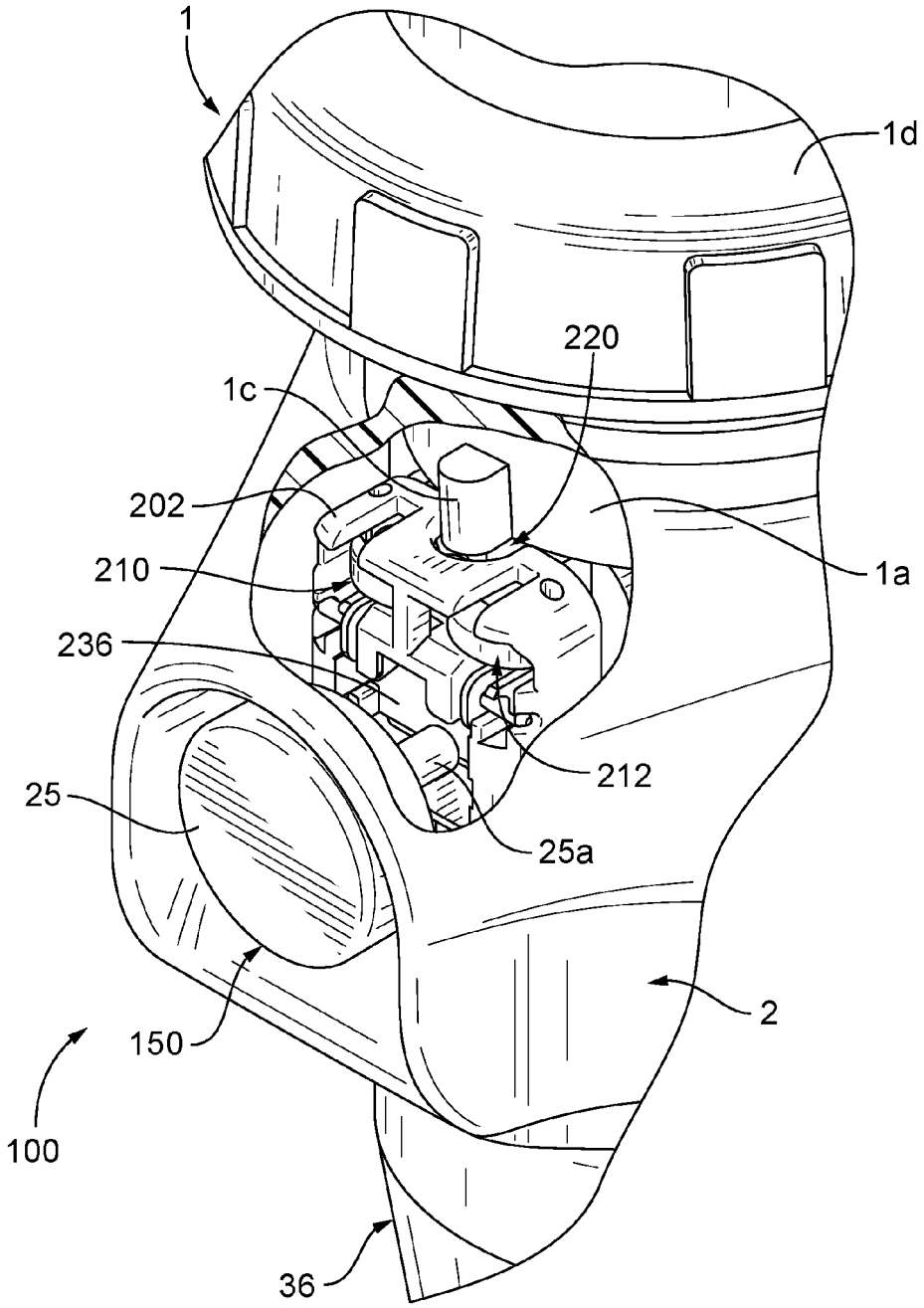
FIG. 20 is a perspective view of a portion of the electrical assembly of FIG. 2, showing an indexing rib on the plug adjacent the indexing rib portal within the latch assembly of FIG. 13, where the latch assembly is in the plug capture position prior to full insertion of the plug into the receptacle.
Figure 21:
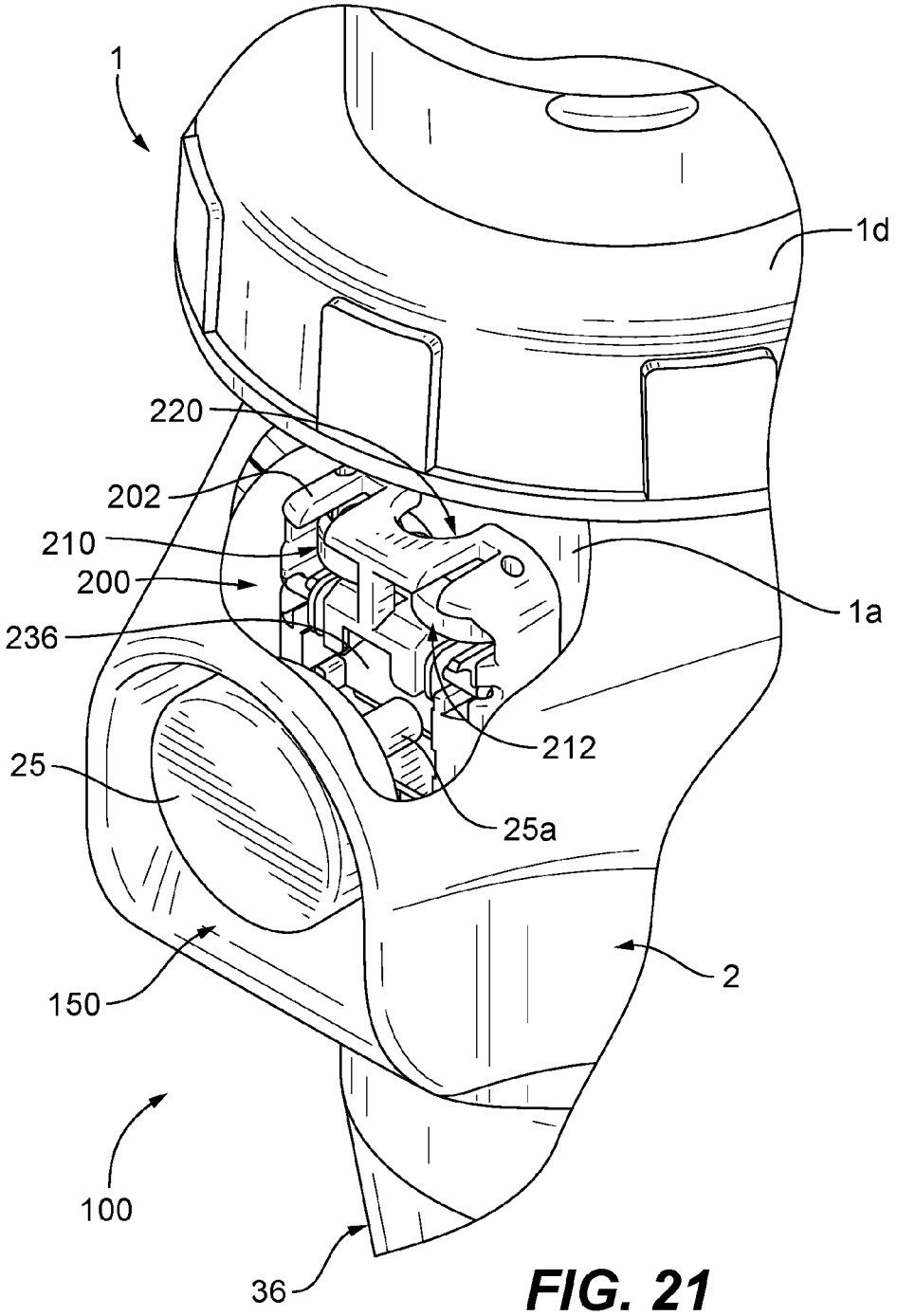
FIG. 21 is a perspective view of the electrical assembly of FIG. 20, showing the latch assembly in plug release position allowing the indexing rib on the plug to pass through the indexing rib portal when the plug is fully inserted into the receptacle.

In addition, and referring to FIGS. 20 and 21, further insertion of the plug 1 into the receptacle 100 pushes the sleeve carrier 10 and the contact sleeves 8 toward the pressure contacts 18 compressing the carriage return springs 11. As this occurs, the indexing rib 1*c* of the plug 1 contacts camming surfaces 210*b* and 212*b* of the latches 210 and 212 respectively causing the latches 210 and 212 to rotate toward the plug releasing position. With the latches 210 and 212 in the plug releasing position, the index rib 1*c* can pass through the indexing rib port 220 into the latch compartment 222 and into the latch lever compartment 224. When the indexing rib 1*c* passes the latches 210 and 212 the force exerted by the indexing rib 1*c* on the camming surfaces 210*b* and 212*b* is removed. As a result, the latches 210 and 212 spring back to the plug capture position, seen in FIG. 16, capturing the indexing rib 1*c* within the latch assembly 200. In this state, the line contact pins 1*b* of the plug 1 are fully seated in the contact sleeves 8 of the receptacle 100 and the contact tips 8*a* of the contact sleeves are in electrical contact with contact tips 18*a* of the pressure contacts 18, as seen in FIG. 11, within the receptacle 100 providing primary electrical power to the plug 1. In addition, if the plug 1 and receptacle 100 include a ground pin 1*e* and ground sleeve assembly 17, the ground contact pin of the plug is within the ground sleeve assembly to provide an electrical path to ground.

Figure 22:
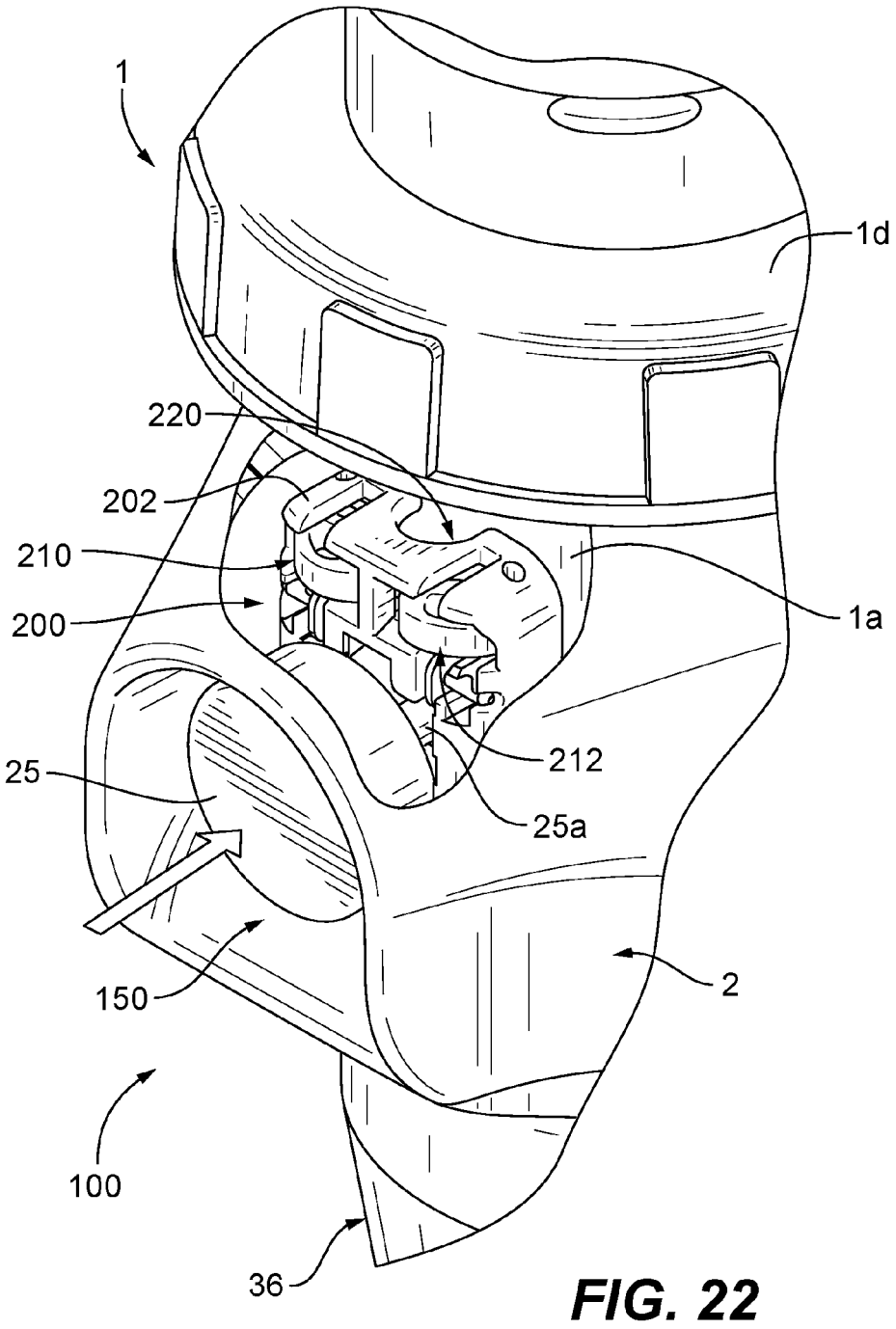
FIG. 22 is a perspective view of the electrical assembly of FIG. 21, showing a pushbutton on the receptacle being depressed to cause the latch assembly to move from the plug capture position to the plug release position to facilitate withdrawal of the plug from the receptacle.
Figure 23:
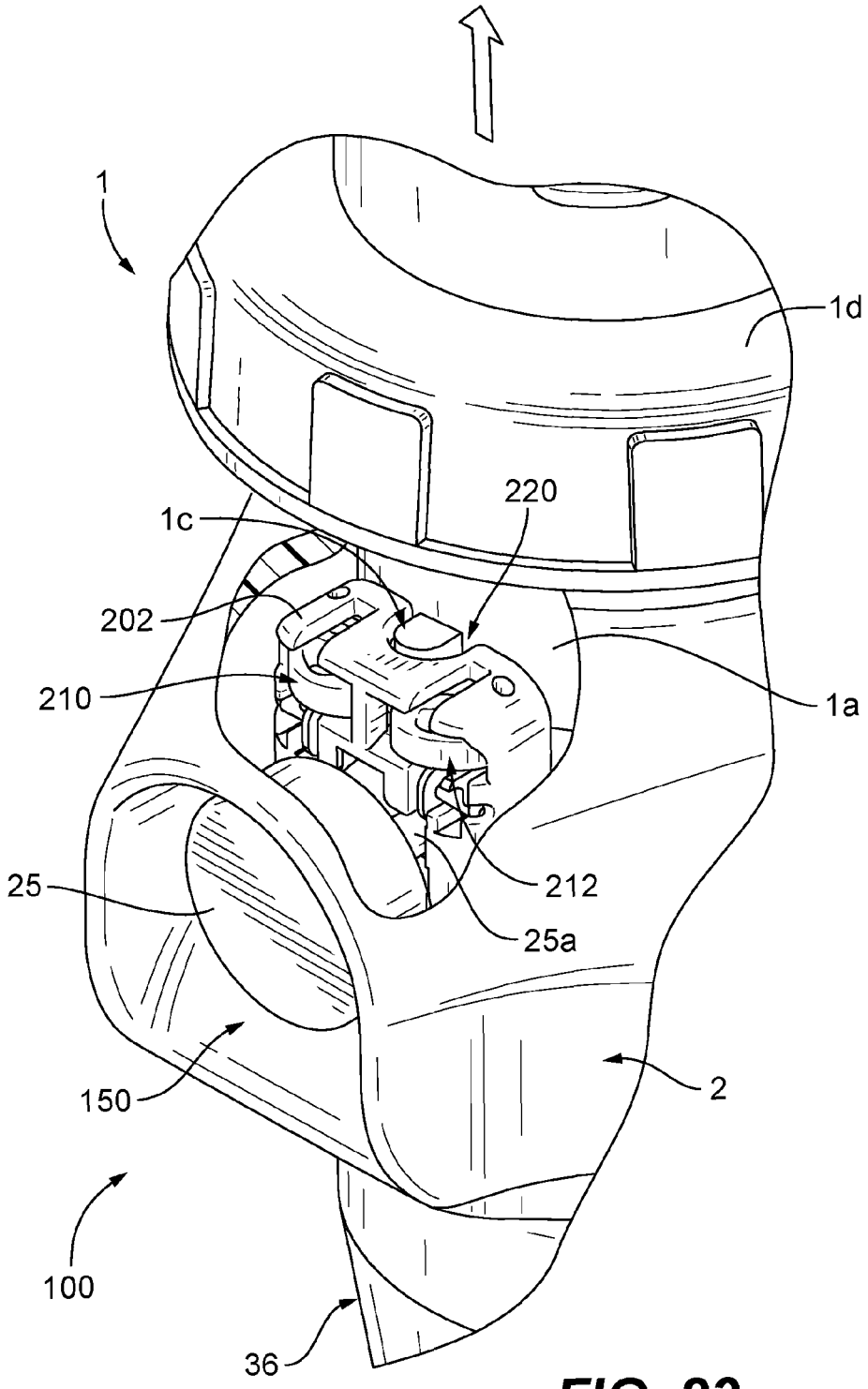
FIG. 23 is a perspective view of the electrical assembly of FIG. 22, showing the pushbutton on the receptacle depressed and showing the latch assembly in the plug release position and the indexing tab passing through the latch assembly as the plug is being withdrawn from the receptacle.

Decoupling of the plug 1 from the receptacle 100 is illustrated in FIGS. 22 and 23. When the pushbutton 25 is pressed as shown in FIG. 22, the pushbutton pin 25*a* engages the latch lever push bar 236 which moves in the direction of arrow "A" seen in FIG. 17. As the latch lever 214 pivots, the latch lever arms 232 and 234 pivot causing the latches 210 and 212 to rotate in the direction of arrow "B", seen in FIG. 19, toward the plug release position. In the plug release position, seen in FIGS. 17-19, the latches 210 and 212 do not block the indexing rib portal 220 allowing the indexing rib 1*c* to pass through the indexing rib portal 220. Axial movement of the plug 1 away from the receptacle 100, as shown in FIG. 23, allows the plug 1 to be decoupled from the receptacle 100.

While the plug 1 is being withdrawn from the receptacle 100, a sequence of movements of the internal components within the receptacle 100 are triggered to electrically decouple the plug 1 from the receptacle 100. More specifically, as the plug is being withdrawn from the receptacle 100, the return springs 11 retract the sleeve carrier 10 back towards the sleeve carrier housing 3. This action separates the contact sleeves 8 from the pressure contacts 18 to break the primary electrical path between the plug and the receptacle. As the plug 1 is further withdrawn from the receptacle 100 the line contact pins 1*b* of the plug 1 begin to separate from their respective contact sleeves 8. At around the same time, the shroud 1*a* of the plug 1 begins to move away from the retaining clips 7 allowing the retaining clips to return to their relaxed state. As the plug 1 is further withdrawn from the receptacle 100 the ground contact pin 1*e* of the plug 1 disengages from the ground sleeve assembly 17 thus maintaining an electrical ground connection until after the line contact pins 1*b* separate from the contact sleeves 8.

While exemplary embodiments have been chosen to illustrate the invention, it will be understood by those skilled in the art that various changes, modifications, additions, and substitutions are possible, without departing from the scope and spirit of the invention. Additions could include additional or other types of arrangements that provide an audible or visible indication of the activation of the latch assembly of the present disclosure. For example, the receptacle could have a visual indicator such as a sliding or rotating colored panel or a colored sleeve collar riding over a colored drum or sphere. Where a movable colored outer panel or surface covers an inner panel or surface, a contrasting color could be used to designate the changing state of power. As another example, an LED could be provided to indicate that the indexing tab 1*c* is locked within the latch assembly of the present disclosure.

What is claimed is:

1. A latch assembly for capturing a plug relative to a receptacle, the latch assembly comprising, a housing having a latch compartment and a latch lever compartment;

a plurality of latches positioned within the latch compartment of the housing and rotatable between a plug capture position and a plug release position;

a latch lever pivotably positioned at least partially within the latch lever compartment, the latch lever having a plurality of latch lever arms wherein one latch lever arm corresponds to one of the plurality of latches; and wherein the plurality of latch lever arms extend into the latch compartment and are operatively coupled to the corresponding latch such that pivotable movement of the latch lever is translated to rotational movement of the latches between the plug capture position and the plug release position.

2. The latch assembly according to claim 1, wherein the plurality of latches comprises two latches.

3. The latch assembly according to claim 2, wherein each of the two latches are rotatably positioned within the latch compartment with a pivot pin and a spring normally biases each latch to the plug capture position.

4. The latch assembly according to claim 1, wherein each of the plurality of latches has an opening and wherein each latch lever arm is positioned within the respective opening to operatively couple the latch lever arm to the latch.

5. The latch assembly according to claim 1, wherein the housing further comprises a portal between an exterior of the housing and the latch lever compartment and positioned relative to the plug capture position.

6. A pin-in-sleeve type electrical connector comprising, a plug having one or more electrically conductive contacts; and a receptacle configured to couple to the plug, the receptacle comprising:

one or more electrically conductive contacts capable of mating with the one or more electrically conductive contacts in the plug such that one electrically conductive contact in the plug mates with one electrically conductive contact in the receptacle; and a latch assembly for capturing the plug relative to the receptacle, the latch assembly comprising:

a housing having a latch compartment and a latch lever compartment;

a plurality of latches positioned within the latch compartment of the housing and rotatable between a plug capture position and a plug release position;

a latch lever pivotably positioned at least partially within the latch lever compartment, the latch lever having a plurality of latch lever arms wherein one latch lever arm corresponds to one of the plurality of latches; and wherein the plurality of latch lever arms extend into the latch compartment and are operatively coupled to the corresponding latch such that pivotable movement of the latch lever is translated to rotational movement of the latches between the plug capture position and the plug release position.

7. The pin-in-sleeve type electrical connector according to claim 6, wherein the plurality of latches comprises two latches.

8. The pin-in-sleeve type electrical connector according to claim 7, wherein each of the two latches are rotatably positioned within the latch compartment with a pivot pin and a spring normally biases each latch to the plug capture position.

9. The pin-in-sleeve type electrical connector according to claim 6, wherein each of the plurality of latches has an opening and wherein each latch lever arm is positioned within the respective opening to operatively couple the latch lever arm to the latch.

10. The pin-in-sleeve type electrical connector according to claim 6, wherein the housing further comprises a portal between an exterior of the housing and the latch lever compartment and positioned relative to the plug capture position.

* * * * *